United States Patent [19]

Ishikawa et al.

[11] Patent Number: 4,821,006

[45] Date of Patent: Apr. 11, 1989

[54] DIELECTRIC RESONATOR APPARATUS

[75] Inventors: Youhei Ishikawa, Kyoto; Kikuo Tsunoda, Yawata; Toshiro Hiratsuka; Hirotsugu Abe, both of Nagaokakyo, all of Japan

[73] Assignee: Murata Manufacturing Co., Ltd., Japan

[21] Appl. No.: 143,808

[22] Filed: Jan. 14, 1988

[30] Foreign Application Priority Data

Jan. 17, 1987 [JP] Japan ..... 62-8525
May 13, 1987 [JP] Japan ..... 62-116426

[51] Int. Cl.[4] ..... H01P 1/20; H01P 1/207; H01P 7/10

[52] U.S. Cl. ..... 333/202; 333/208; 333/212; 333/219.1; 333/246

[58] Field of Search ..... 333/219, 202, 208, 212, 333/209, 210, 211, 227, 235, 219.1, 246; 331/96, 107 DP

[56] References Cited

U.S. PATENT DOCUMENTS 4,423,397 12/1983 Nishikawa et al. ..... 333/248 X

*Primary Examiner*—Marvin L. Nussbaum
*Attorney, Agent, or Firm*—Ostrolenk, Faber, Gerb & Soffen

[57] ABSTRACT

The dielectric resonator apparatus is characterized in that electric walls exist on one plane or two including the central axis of the electromagnetic field distribution in the using mode of a dielectric resonator, a dielectric resonator with either of dielectrics between the electric wall being removed in shape is provided by plurality, an equivalent axis is common to the central axis of each of the dielectric resonators, with the dielectric resonators being inductively coupled in the axial direction. A dielectric resonator which prevents the current from being concentrated on the central axis of the electromagnetic field distribution, is collectively smaller in the Joule loss and is higher in Q. The dielectric resonator of the present invention is characterized in that the dielectric close to the central axis is removed, wherein electric walls exist on one plane or two including the central axis of the electromagnetic field distribution in a dielectric resonator using, for instance, a $TE_{01\delta}$ mode, with either of dielectrics between the electric wall being removed in shape.

30 Claims, 14 Drawing Sheets

| | Resonator | Base plate |
|---|---|---|
| material | (Zr, Sn) $TiO_4$ | $2MgO \cdot SiO_2 - ZrSiO_4$ |
| dielectric constant ($\varepsilon r$) | 37.5 | 8.5 |
| dielectric loss ($\tan\delta$) | $4.2 \times 10^{-5}$ (800MHz) | |
| $\frac{1}{\tan\delta} \frac{\Delta \tan\delta}{\Delta T}$ | 2 % / 10 °C | |
| temperature coefficient ($\eta fo$) | +2PPM / °C | |
| thermal expansion coefficient ($\alpha$) | 6.5 PPM / °C | 6.5 PPM / °C |

| | |
|---|---|
| center frequency (fo) | 880 MHz |
| passing band | fo ± 10 MHz |
| attenution amount (fo ± 35 MHz) | 95 dB |
| insertion loss (fo 10 MHz) | 0.37 dB |
| VSWR | 1.37 |

| | resonator | base plate |
|---|---|---|
| material | (Zr, Sn) $TiO_4$ | $2MgO \cdot SiO_2$–$ZrSiO_4$ |
| dielectric constant ($\varepsilon r$) | 37.5 | 8.5 |
| dielectric loss ($\tan\delta$) | $2.5 \times 10^{-5}$ (800MHz) | |
| $\frac{1}{\tan\delta} \frac{\Delta \tan\delta}{\Delta T}$ | 2% / 10°C | |
| temperature coefficient ($\eta fo$) | +2PPM /°C | |
| thermal expansion coefficient ($\alpha$) | 6.5 PPM/°C | 6.5 PPM/°C |
| thermal conductivity (K) | 0.02 J/cm·deg·sec | |

| | |
|---|---|
| center frequency (fo) | 880MHz |
| passing band | fo±10MHz |
| attenuation amount (fo±35MHz) | 90dB (minimum) |
| insertion loss (fo±10MHz) | 0.45dB (maximum) |
| V S W R | 1.5 (maximum) |
| input power | 500W (maximum) |
| volume | 3.0 ℓ (maximum) |

DIELECTRIC RESONATOR APPARATUS

BACKGROUND OF THE INVENTION

The present invention generally relates to a small-sized dielectric resonator apparatus, and more particularly, to a dielectric resonator using a $TE_{01\delta}$ mode.

Generally, dielectric resonators may comprise resonators which are smaller in size and higher in Q as compared with the conventional metallic cavity resonators. Note for example, the dielectric resonator apparatuses which are used as band-pass filters in transmitter multiplexers or the like in microwave communication apparatuses.

The construction of a dielectric resonator varies in accordance with the electromagnetic wave mode being used, with a particular mode being used in accordacne with a particular object. For example, in the $TE_{01\delta}$ mode, which is not very good with respect to spurious characteristics, the degree of energy concentration of the resonator is high, and the loss of the entire resonator is determined only by the loss of the dielectric resonator, so that a higher Q may be provided. In the case of the TEM mode, the spurious characteristics are good, but the loss of the metallic conductor is comparatively large, whereby the Q of the resonator is not so high. Although the TM mode advantageously shows intermediate characteristics between these two modes, the conductivity of the splicing face has to be properly retained, because an actual current flows across the splicing face between the dielectric resonator and its case. For this purpose, it is necessary to absorb any mechanical distortion which is caused by the difference between the thermal expansion coefficient of a dielectric resonator made of ceramics and that of a case, so metallized ceramics are required to be used as the material of the case.

In view of the preceding metal, which is superior to treat, is used as the case. In order to improve a Q, the dielectric resonator of the $TE_{01\delta}$ mode is used.

In a dielectric resonator using the conventional $TE_{01\delta}$ mode, a cylindrical dielectric resonator, which is made of, for example, $TiO_2$ system ceramic material, is secured on a cylindrical support stand within a closed metallic case. As this type of dielectric resonator uses dielectric ceramics as described hereinabove, it may be smaller than a metallic cavity resonator. As the electromagnetic energies are fully concentrated within the dielectric resonator, resonator with the higher Q may be constructed.

Conventionally, when a band-pass filter is constructed with a plurality of these dielectric resonators arranged within the same case, the above-described cylindrical dielectric resonators are inductively coupled in the lateral direction, being arranged in one plane within the metallic case. A filter arranged according to this method has disadvantages in that asymmetrical modes such as $EH_{11\delta}$, $TM_{01\delta}$, $HE_{11\delta}$, etc. are likely to be excited, and the spurious characteristics are inferior.

In another known dielectric resonator apparatus, a plurality of cylindrical dielectric resonators, are ideally located along the central shaft of each dielectric resonator and are arranged in the central axis direction. FIG. 27 is a partially broken away perspective view showing the construction of the apparatus. In FIG. 27, the cylindrical dielectric resonators 21, 22, 23, 24 are each secured by a ring-shaped spacer 31 within the metallic case 30.

Another known dielectric resonator apparatus includes fan-shaped partial cylindrical dielectric resonators, and uses the symmetrical property of the electromagnetic wave mode to make the whole apparatus smaller in size, and improved in radiation property. FIG. 28(A), and FIG. 28(B) are respectively a top view and a front view showing the inside construction of the apparatus. In FIG. 28, the cylindrical dielectric resonators 51 through 54 are cut in half by a plane containing the central axis thereof, with the cut face being secured in contact against the metallic case 40. Reference characters 43, 45 show input, output connectors, and reference characters 42, 44 show rods which provide the coupling circuit.

In the conventional dielectric resonator apparatus shown in FIG. 27, the above-described asymmetrical mode is hard to excite, and the spurious characteristics are good, but it also has diadvantages, in that the reliability is lower in terms of strength if synthetic resin is used as a spacer 31, and the unloaded Q, i.e., $Q_0$ is lower because of low tan $\delta$. The thermal expansion coefficient of the metallic case 30 is considerably different from that of the spacers when ceramic material is used as the spacers, and it is difficult to absorb the mechanical distortion caused by the thermal expansion. In the dielectric resonator apparatus shown in FIG. 28(A), (B), each of the dielectric resonators is in contact against the inner wall of the metallic case without any interval therebetween, so that the whole is smaller in size and the radiation effect becomes higher. However, as in the conventional dielectric resonator apparatus wherein a plurality of cylindrical dielectric resonators are arranged along a plate, the asymmetrical mode is likely to be excited, the spurious characteristics are inferior, and furthermore the design property is worse.

SUMMARY OF THE INVENTION

Accordingly, an object of the present invention is to provide a dielectric resonator apparatus, which is harder to excite in an asymmetrical mode, is smaller in size and improves the radiation effect, and is generally superior in characteristics, than the above-mentioned prior art apparatus. Therefore, the dielectric resonator apparatus of the present invention is characterized in that electric walls exist on one plane or two, each said plane including the central axis of the electromagnetic field distribution in the operating mode of a dielectric resonator. A plurality of dielectric resonators with their dielectric material adhered to the electric wall are provided. Each said resonator has the shape of a cylindrical resonator with a portion of the dielectric material being removed. The central axis of each of the dielectric resonators is lined up along an imaginary straight line, with the dielectric resonators being inductively coupled in the axial direction.

In the preferred embodiment, the dielectric resonator is, for instance, formed as a quarter section of a cylindrical dielectric resonator. Its shapes is defined by an arcuate surface having a given radius and a pair of the radial rectangular outer planes, each having a given angle to the other, said pair of rectangular outer planes forming the electric walls and being crossed along the central axis with each other, and further by a pair of top and bottom planes each having the shape of a quarter circle.

Accordingly, in the dielectric resonator apparatus of the present invention, each dielectric resonator operates as in, for example, the conventional cylindrical dielectric resonator, because electric walls exist in one plate portion or two to produce the image of the electromagnetic wave mode by these electric walls. As the respective dielectric resonators are arranged to be common in these respective axes, the asymmetrical mode such as $EH_{11\delta}$, $TM_{01\delta}$, $HE_{11\delta}$ or the like is harder to excite, which improves the spurious characteristics. Also, the respective small-sized dielectric resonators are smaller than, for example, the conventional cylindrical dielectric resonators, and the conductive face is in contact against one plane portion or two to improve the radiation effect. Accordingly, a dielectric resonator apparatus which is collectively smaller-sized is obtained.

Also, another object of the present invention is to provide a dielectric resonator which prevents the current from being concentrated on the central axis of the electromagnetic field distribution, so that the resonator is lower in Joule loss and is higher in Q. Accordingly, a dielectric resonator of the present invention is characterized in that the dielectric close to the above-described central axis is removed, wherein electric walls exist on one plane or two including the central axis of the electromagnetic field distribution in a dielectric resonator using a $TE_{01\delta}$ mode, with the dielectric material adhered to the electric wall being partially removed.

In other words, the dielectric resonator is, for instance, formed as a quarter section of a cylindrical dielectric resonator. Its shape is defined by a first arcuate surface of a large radius, a second concentric arcuate surface of a small radius disposed along the large radius, said first and second arcuate surfaces having a common axis, a pair of rectangular outer planes forming electric walls at right angles to each other and each including said common axis, and a pair of top and bottom planes each being perpendicular to said rectangular outer planes and having the shape of a cross-section of the space defined by said arcuate surfaces.

Therefore, in the dielectric resonator of the present invention, the electric walls exist on one plane or two including the central axis of the electromagnetic field distribution. A dielectric resonator using the $TE_{01\delta}$ mode is formed with a portion of the dielectric material adhered to the electric wall being removed. The distribution of the displacement current flowing into the dielectric from the removing of the dielectric close to the central axis is kept away from the central axis. Thus, the central axis and its vicinity are hollowed out, to reduce the overall Joule loss. Accordingly, a dielectric resonator which is higher in Q may be constructed.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF THE INVENTION

Figure 1:
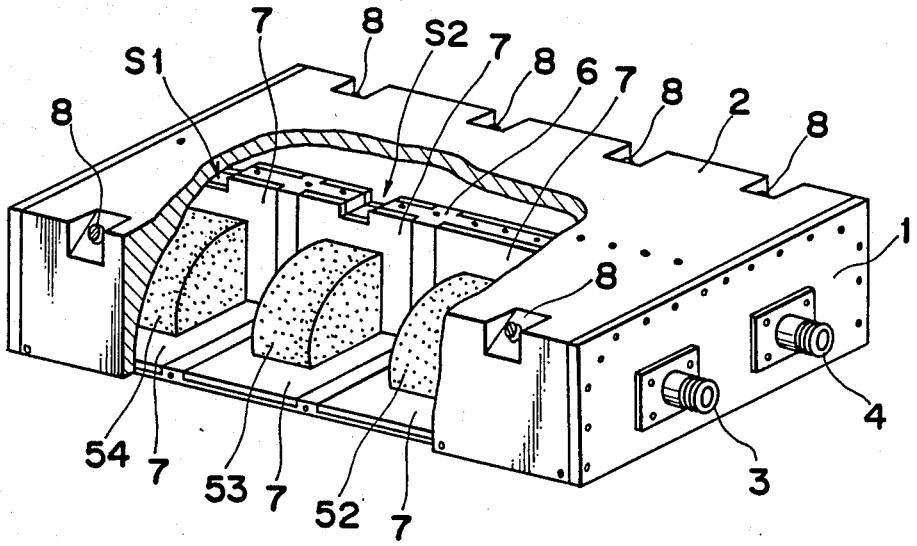
FIG. 1 is a partially broken-away perspective view showing the construction of a dielectric resonator apparatus in a first embodiment of the present invention.

Before the description of the present invention proceeds, it is to be noted that like parts are designated by like reference numerals throughout the accompanying drawings.

First Embodiment

FIG. 1 is a partially broken away perspective view showing the construction of a dielectric resonator apparatus according to a first embodiment of the present invention. In FIG. 1, a box-shaped case is constructed by the combination of two case members 1 and 2. The case members are made of metallic material such as iron, aluminum alloy or the like. A pair of N-type connectors 3, 4 for input use and for output use, respectively are mounted on one side face of the case member 1. A metallic plate 6 which stands upright in a central portion is disposed within the metallic case. A plurality of ceramic base plates 7 are respectively engaged with both the sides of the metallic plate 6 and the bottom face of the case member 1. The ceramic base plate 7 is coated all over its surface with silver electrodes to form an electric wall. A dielectric resonator which is a greater segment of a cylindrical dielectric resonator is fixedly baked onto each of said silver electrodes. These dielectric resonators 51 through 58 are accommodated within the case with only the dielectric resonators 52 through 54 being shown in FIG. 1.

Each of the dielectric resonators 51–58 has the form of a 90-degree segment of a disc-shaped cylindrical dielectric resonator. That is, the cross-section of each resonator is defined by a 90-degree arc of a circle having a given radius and further by a pair of radial planes at right angles to each other. Accordingly, each resonator comprises a pair of rectangular outer planes forming electric walls, each including one of the radiuses, and crossed with each other along a central axis common to both planes, a pair of top and bottom planes each having the same shape of the above-described cross-section, and a curved surface above-described including the arc. The shape of these resonators may be referred to herein as a "quarter-cylinder" or "solid quarter-cylinder."

Figure 2:
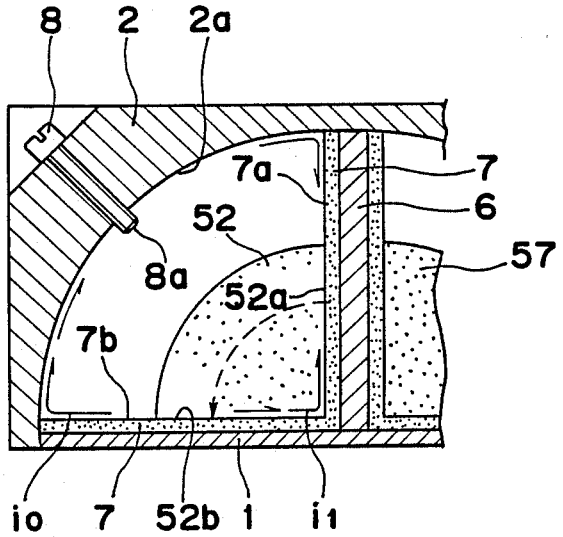
FIG. 2 is a partial sectional view of the apparatus shown in FIG. 1.

FIG. 2 is a partial sectional view of the apparatus shown in FIG. 1, with the section being taken along a plane parallel to the end face on which the connectors 3, 4 are formed. In FIG. 2, one outer plane 52*a* including the central axis of one dielectric resonator 52 is in contact against the vertical face of the ceramic base plate 7, with the other outer plane 52*b* being secured in contact against the horizontal face of the ceramic base plate 7. The inner wall 2*a* of the case member 2 defines a cylindrical face with the central axis of the dielectric resonator as a center. The cylindrical face 2*a* is formed for easier characteristic calculation. It is not necessarily made in such a shape. In the drawing, an adjusting screw 8 for frequency tuning use is made of metal or dielectric, is engaged with a tapped hole provided in the corner portion of the case member 2. The adjusting screw 8 is rotated to protrude its tip 8*a* into the case to effect frequency tuning adjustment by the amount it projects into the case.

The resonator system shown in FIG. 2 is used in the $TE_{01\delta}$ mode. In this case, a displacement current flows in a direction shown with a broken line within the dielectric resonator, a main actual current i1 flows into the interface portion between the silver electrodes 7*a*, 7*b* formed on the surface of the ceramic base plate 7 and the external plane of the dielectric resonator, and a leakage current i0 of the actual current flows to the inner wall 2*a* of the case member 2. In other words, current should not flow through locations where the current is likely to be prevented from flowing smoothly, such as the splicing base between the case main body in the metallic case and the cover. Such locations do not exist in a route where resonance current strongly flows in this invention, with integrated electrodes being provided thereon. As the resonance current flowing to the case is a leakage current, a metallic case composed of two case members combined may be adopted. The metallic case is superior in productivity and the construction thereof is higher in industrial value. Also, in this case, the dielectric resonators 52, etc. are heated through the dielectric loss or the Joule loss of the peripheral conductor, so that the heat is discharged from the case members 1 and 2 through the ceramic base plate 7 and the metallic plate 6. Accordingly, the heat is easily radiated externally so that it may be used even in a large power circuit. At the same time, as the dielectric resonators 52, etc. are secured through the ceramic base plate 7 bonded on the case member, the mechanical distortion which is caused because of the difference in the thermal expansion between the case member composed of the metallic material and the dielectric resonator composed of the ceramic material may be absorbed. Therefore, it is possible to maintain the excitation of the perfect $TE_{01\delta}$ mode without the peeling-off of the splicing portion between the silver electrode on the ceramic base-plate surface serving as the electric wall and the dielectric resonator.

It is to be noted that the respective ceramic base plates 7 may be integrated so as to compose a single base plate. Furthermore, the respective silver electrodes 7*a*, 7*b* may be, also, constituted as one continuous electrode. Also, both the ceramic base plates and dielectric resonators may be formed as one unit with ceramic materials.

Figure 3:
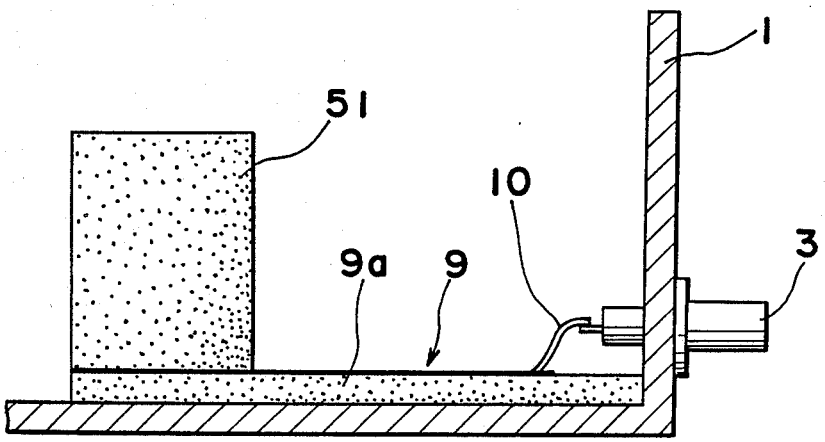
FIG. 3 is a partial sectional view of the dielectric resonator apparatus shown in FIG. 1.
Figure 4:
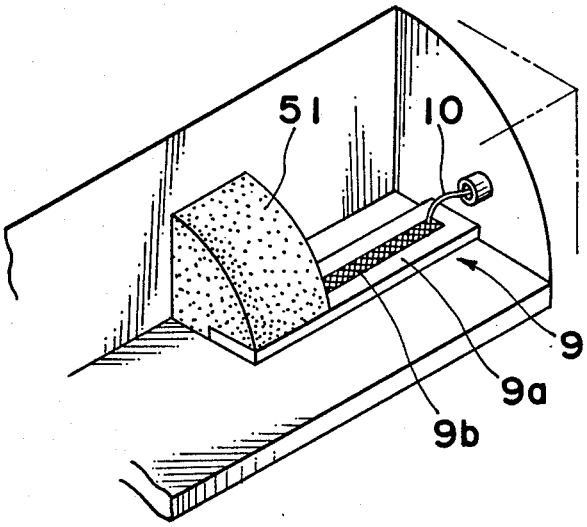
FIG. 4 is a perspective view of the portion shown in FIG. 3.
Figure 5:
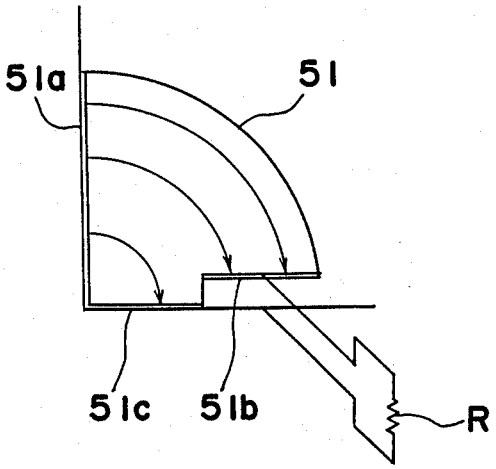
FIG. 5 and FIG. 6 are diagrammatic views showing the construction of a first stage dielectric resonator and the equivalent circuit thereof.
Figure 6:
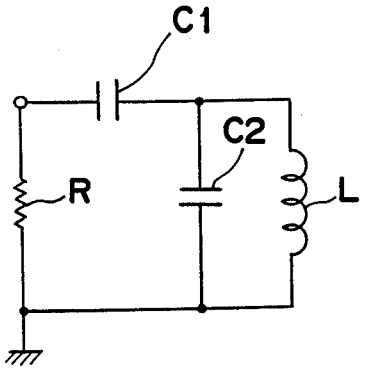

FIG. 3 shows a partial sectional view taken perpendicularly with respect to the side face of the case member with a connector 3 mounted thereon as shown in FIG. 1, which includes a first stage of the apparatus, including a dielectric resonator 51, a base plate 9*a* of a strip line 9, and a lead wire 10 for connecting the control conductor of the input connector 3 with the strip line 9. FIG. 4 is a perspective view showing this portion. The strip line 9 is composed of a strip base plate 9*a* and a strip conductor 9*b*, with the lead wire 10 connecting the central conductor of the input connector 3 with the strip conductor 9*b*. A silver electrode is formed on the bottom face of the first stage dielectric resonator 51, being connected in direct contact with the strip conductor 9*b*. In this manner, the dielectric resonator 51 is electrically connected with the input connector 3. FIG. 5 and FIG. 6 show an electrode formed on each plane of the dielectric resonator 51 shown in FIG. 3 and FIG. 4, and an equivalent circuit of the engagement circuit in this input circuit. In FIG. 4, it is noted that a step-like cut-out portion is provided on one of the outer planes 51*c* of the resonator 51 to present a space for inserting the leading portion of the strip line 9 therein. In FIG. 5, an electrode 51*a* formed on the vertical face corresponds to a coil L in FIG. 6, with the capacity between the electrodes 51*a* and 51*b* in FIG. 5, and the capacity between the electrodes 51*a* and 51*c* respectively corresponding to capacitors C1, C2 in FIG. 6. A resistor R shows the impedance of the load connected to the connector 3. The input impedance is set by the size and the shape of the electrode to be formed on the horizontal face of the first stage dielectric resonator so as to match the coaxial cable to be connected with the input connector 3.

The embodiment shown in FIG. 3 through FIG. 6 shows the coupling circuit of the input portion, with a similar circuit being provided on the output side.

Figure 7:
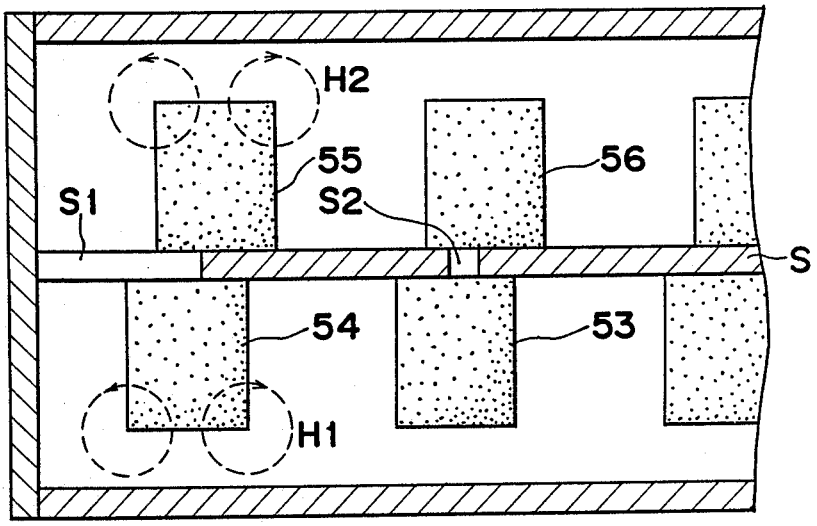
FIG. 7 is a partial sectional view of the dielectric resonator apparatus shown in FIG. 1.

FIG. 7 is a view showing in part a cross-section taken parallel to the bottom face of the apparatus shown in FIG. 1 or to the top face thereof, which includes the third through sixth stages of dielectric resonators 53 through 56, a shielding plate S for dividing the interior of the case member into two and separating one group of the resonators 55, 56 on one surface plane from the other group of the resonators 53, 54 on th other surface plane. An opening portion S1 is provided to pass through the shielding plate for coupling between the fourth stage dielectric resonator 54 and the fifth stage dielectric resonator 55. A slot S2 is provided for coupling between the third stage dielectric resonator 53 and the sixth stage dielectric resonator 56. As described hereinabove, each of these dielectric resonators is used in the mode $TE_{01\delta}$ and at the same time the mode of the second harmonic wave is also excited. The production of the second harmonic wave is one of the causes of poor spurious characteristics. In the embodiment, in the coupling between the fourth stage dielectric resonator 54 and the fifth stage dielectric resonator 55, the coupling of the second harmonic wave is removed. Namely, the second harmonic wave magnetic force line H1 may be produced in the dielectric resonator 54, and the second harmonic wave magnetic force line H2 may be produced in the dielectric resonator 55. Two dielectric resonators are disposed in the positional relation with the mutual vectors of the second harmonic wave magnetic field of the two dielectric resonators being orthogonal as integral values to cancel the coupling of the second harmonic wave.

According to the embodiment, as quarter-cylindrical dielectric resonators are used, the above-described asymmetrical mode is not excited, thus improving the spurious characteristics as compared with the conventional cylindrical shape of a dielectric resonator. Although the asymmetrical mode is somewhat caused in the case except for the quarter-cylindrical shape, the E mode exists no longer, so the spurious characteristics are better as compared with those of FIG. 27.

Furthermore, in FIG. 7, the third stage dielectric resonator 53 is weakly connected with the sixth stage dielectric resonator 56 because of the existence of the slot S2. As a result, an attenuation pole is caused from the characteristics of the band-pass filter to improve the filter characteristics.

Figures 8, 9:
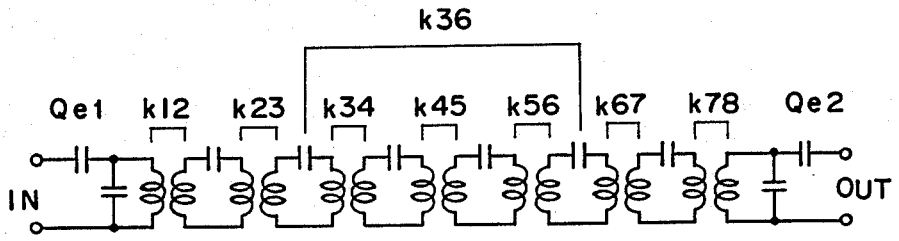
FIG. 8 is an equivalent circuit of the above-described dielectric resonator apparatus.
FIG. 9 is a chart showing the materials of the resonator and the ceramic base plate constructing the above-described apparatus, and their characteristics.

A band-pass filter using the above-described eight stage dielectric resonator apparatus is constructed in the above-described manner. FIG. 8 shows its equivalent circuit, wherein reference character Qe1 shows a coupling portion between the connector 3 and the first stage dielectric resonator 51, reference character Qe2 shows a coupling portion between the eighth stage dielectric resonator 58 and the connector 4. Also, reference characters K12, K23, K34, K45, K56, K67, K78 respectively show the coupling portions among the dielectric resonators of the stage number shown by two-unit figures. The reference character K36 shows the coupling portion between the third stage dielectric resonator 53 and the sixth stage dielectric resonator 56 because of the existence of the slot S2 shown in FIG. 1 and FIG. 7.

The construction materials of the band-pass filter, the concrete examples of each size, and examples of their characteristics under operating conditions are shown hereinafter.

Figures 10, 11:
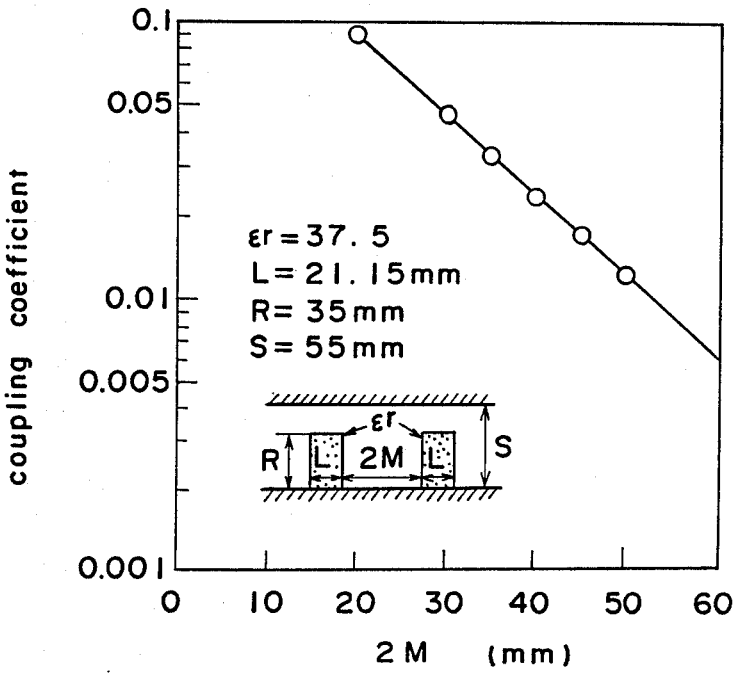
FIG. 10 is a chart showing the characteristics of a concrete band-pass filter employing the apparatus of FIG. 1.
FIG. 11 is a graph showing coupling coefficients between the respective dielectric resonators.
Figure 12:
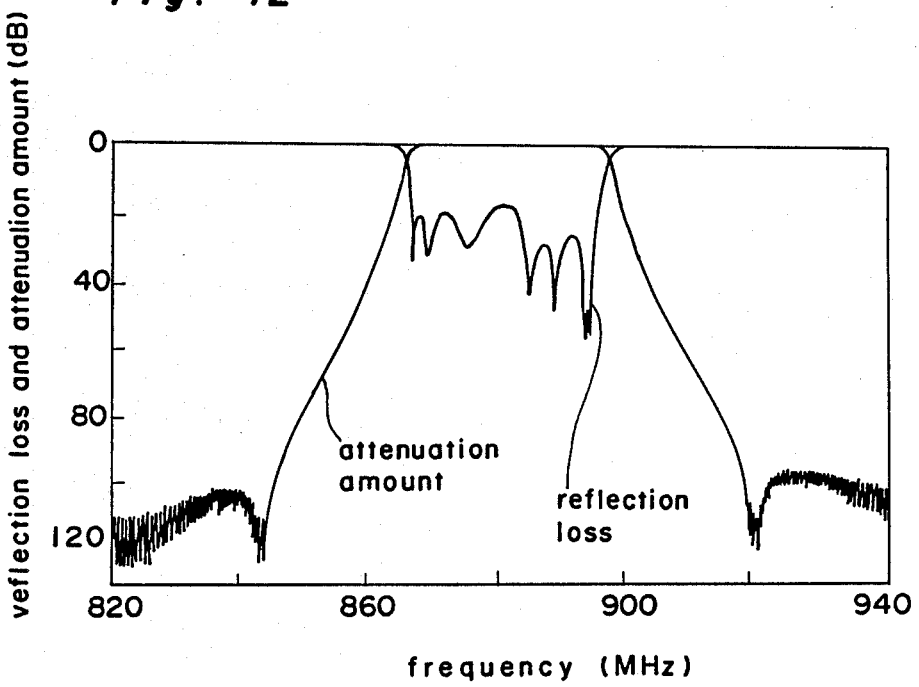
FIG. 12 and FIG. 13 are graphs each showing the characteristics as the band-pass filter.
Figure 13:
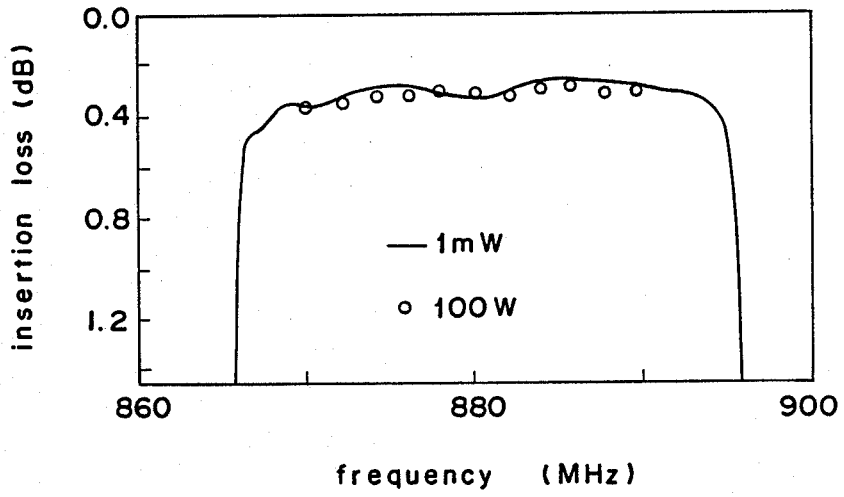

FIG. 9 shows the materials of each resonator and of the ceramic base plate for retaining these resonators. Also, FIG. 11 shows the coupling coefficients between the dielectric resonators according to the size and positional relation of each dielectric resonator. FIG. 12 and FIG. 13 are graphs showing the characteristics of the band-pass filter constructed under such conditions. FIG. 12 shows the reflection loss and the attenuation amount with respect to the frequency. FIG. 13 shows the insertion loss with respect to the frequency. FIG. 10 shows the band-pass filter specification. As shown in FIGS. 9–13, a the band-pass filter of low insertion loss and large attenuation amount may be constructed according to the invention.

Figure 14A:
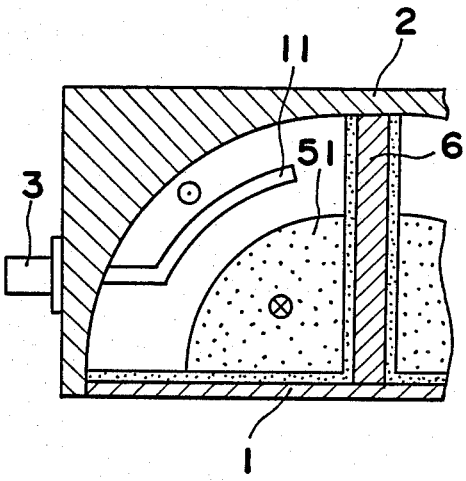
FIGS. 14(A), 14(B) and 14(C) are views showing an alternate embodiment of a coupling circuit which may be employed in the input, or output of the dielectric resonator apparatus.
Figure 14B:
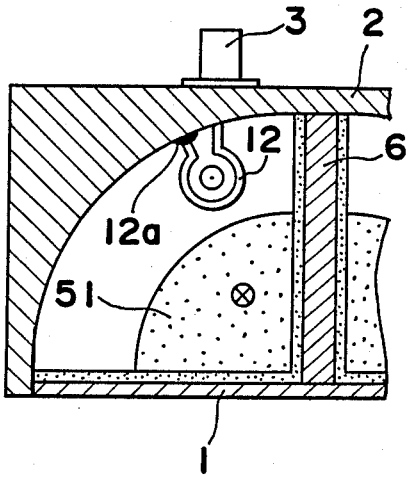
Figure 14C:
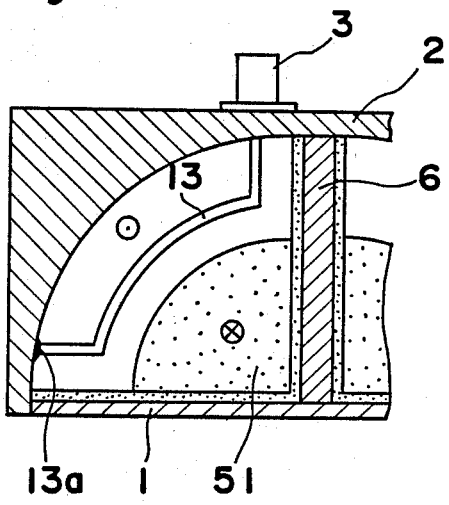

In the above-described embodiment, the connection of the input, output portions is effected by capacitive coupling, and furthermore, input and output may be effected by inductive coupling. FIGS. 14(A) through 14(C) show the examples in this case. In the example of FIG. 14(A), a metallic rod 11 is projected along the interior of the case of the connector 3 mounted on the side face of the case, and the magnetic-force lines caused by the metallic rod 11 are interlinked with the dielectric resonator 51. In the example of FIG. 14(B), a loop 12 made of metallic wire is formed within the case, with the loop being electrically connected, at its one end 12*a*, with the case by soldering or the like, and being connected, at its other end, with the connector 3 formed on the top face of the case. In the example of FIG. 14(C), the metallic wire 13 is provided concentrically between the inner wall of the case and the dielectric resonator, with the metallic wire being, at its one end 13*a*, connected with the case interior, and at its other end, with the connector 3, resulting in that the metallic rod or the metallic wire and the dielectric resonator are inductively coupled to each other.

Figure 15:
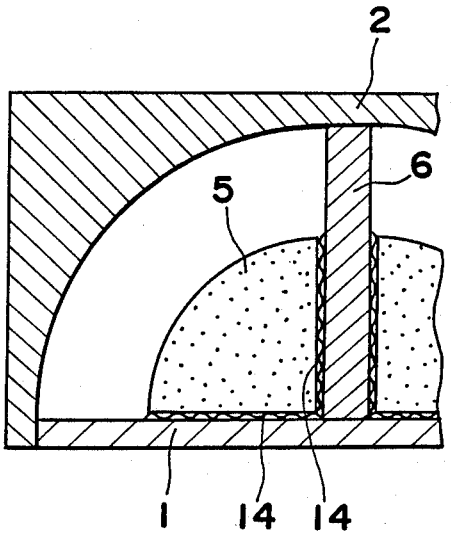
FIG. 15 is a cross-sectional view showing an alternate embodiment of a construction for securing a dielectric resonator.

In the above-described embodiment of FIGS. 1–13, the ceramic base plate having the silver electrode formed on the surface is used when the dielectric resonator is brought into contact against the inner wall or the like of the case and secured. In addition, the dielectric resonator may be secured by, for example, an elastic member made of a metallic material as shown in FIG. 15. In FIG. 15, a metallic plate 14 or metallic net formed in wave shape is bonded by partial soldering or secured with the synthetic-resin system of bonding agent. By this plate or net 14, mechanical distortion caused by the difference in thermal expansion between the dielectric resonator made of the ceramic material and the case member made of metallic material, may be absorbed.

Figure 27:
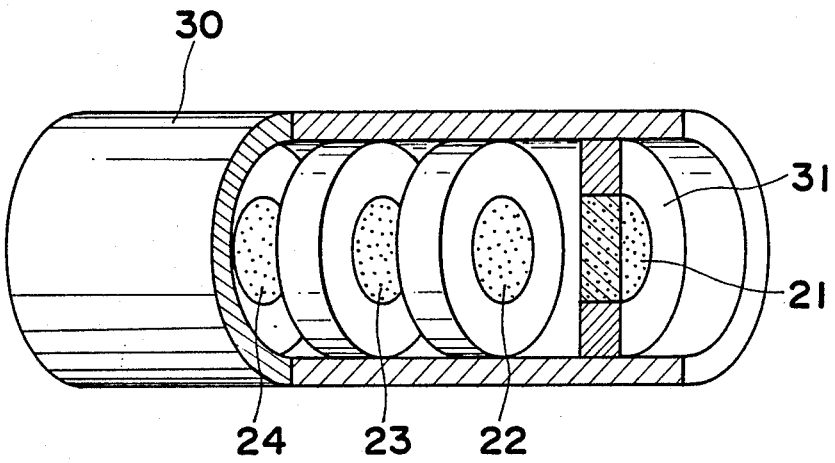
Fig. 27 PRIOR ART
FIG. 27 and FIGS. 28(A), 28(B) are views showing the construction of a conventional dielectric resonator apparatus.
Figure 28A:
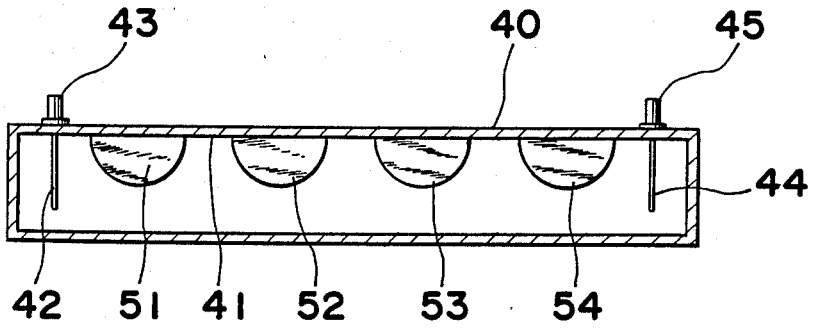
Fig. 28(A) PRIOR ART
Figure 28B:
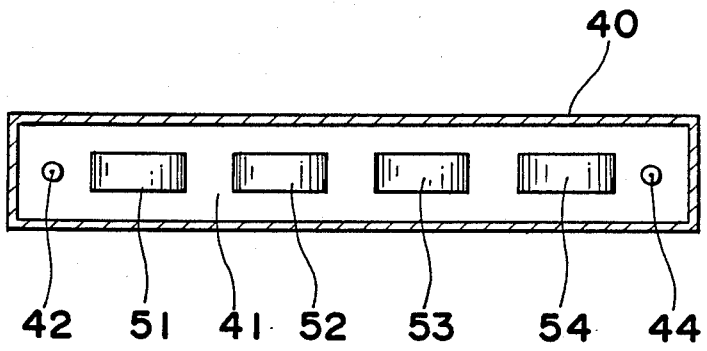
Fig. 28(B) PRIOR ART

In the above-described embodiment, a quarter-cylindrical dielectric resonator similar to a fan opening by 90° is used. In addition, a dielectric resonator whose fan opening angle is smaller than 90° may be used. In this case, if the fan opening angle is made too small, the unloaded loss is increased which will reduce the unloaded Q. When the angle is made larger by 18°, for example, the size of the resonator cannot be made very small. However, the radiating effect becomes better as compared with such conventional dielectric resonator as shown in FIG. 27.

According to the first embodiment of the present invention, as a plurality of small-sized dielectric resonators are inductively coupled in the axial direction with the axis of each resonator being common, a filter which is high in design property, is hard to be excited in asymmetrical mode, and is superior in spurious characteristics may be constructed as in the conventional dielectric resonator apparatus connected in the central axial direction. As the external size of each dielectric resonator may be, also, made smaller, the entire dielectric resonator apparatus may be made smaller. As each dielectric resonator is in direct contact against the inner wall or the like of the case, the radiating effect is higher, which may be used even in the circuit for large power use.

Second Embodiment

Figure 16:
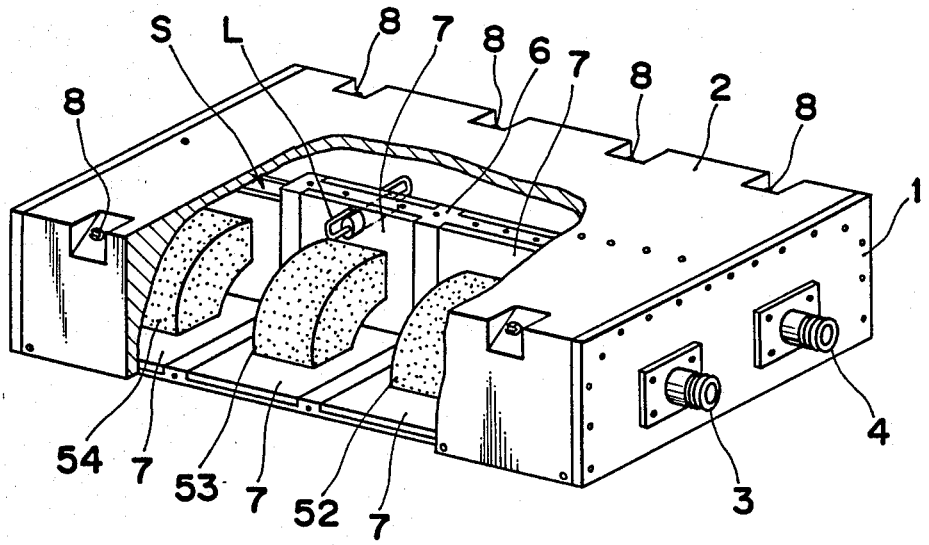
FIG. 16 is a partially broken away perspective view showing a second embodiment of a band-pass filter using the dielectric resonator of the present invention.

FIG. 16 is a partially broken-away persective view showing the construction of a band-pass filter using a dielectric resonator according to a second embodiment of the present invention. Referring to FIG. 16, a box-shaped case is constructed through the construction of two case members 1, 2, which are made of metallic material. A pair of N-type connectors 3, 4 for input use and for output use are mounted on one side face of the case member 1. A metallic plate 6 which stands upright at the central portion is disposed within the metallic case. A plurality of ceramic base plates 7 are respectively engaged with both the sides of the metallic plate 6 and the bottom face of the case member 1. Each ceramic base plate 7 is coated all over the surface with silver electrodes. The dielectric resonator, which has the shape of a quarter of a hollow cylinder, and having flat faces in contact with the electrodes, is fixedly baked on the silver electrodes. The shape of these resonators may be referred to herein as a "hollow quarter-cylinder." Each dielectric resonator has the shape of a 90-degree segment of a disc-shaped cylindrical dielectric resonator with a hollow cylindrical center. That is, the cross-section of each resonator is defined by a first 90-degree circular arc of a large radius, a second concentric 90-degree circular arc of a small radius, and further by a pair of radial planes at right angles to each other. Accordingly, each resonator comprises a pair of rectangular outer planes forming electric walls, each including one of the radiuses, a pair of top and bottom planes each having the same shape of the cross-section, a large convex surface including the first arc, and a small concave surface including the second arc. In the dielectric resonator of such construction, the electric wall in the $TE_{01\delta}$ mode dielectric resonator exists in a position where the electrode exists. The electrode operates as a dielectric resonator of the $TE_{01\delta}$ mode similar to that of a cylindrical dielectric resonator before it is divided into fourths. The eight dielectric resonators 51–58 are accommodated within the case (in FIG. 16, only resonators 52–54 are shown). It is to be noted that the loop L obtains magnetic coupling between the third stage resonator 53 and the sixth stage resonator 56 (not shown), and the slit S obtains magnetic coupling between the fourth stage resonator 54 and the fifth stage resonator 55 (not shown).

Figure 17:
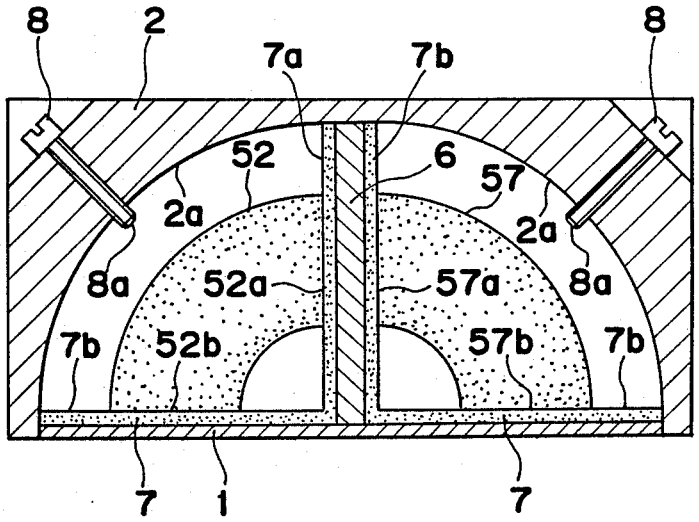
FIG. 17 is a longitudinal sectional view of the apparatus shown in FIG. 16.

FIG. 17 is a sectional view of an apparatus shown in FIG. 16, showing a section taken according to a plane parallel to the end face on which the connectors 3, 4 are formed. In FIG. 17, dielectric resonators 52, 57 respectively have division faces 52*a*, 52*b* and 57*a*, 57*b* fixedly baked in contact against the vertical faces 7*a*, 7*a* and the horizontal faces 7*b*, 7*b* of the ceramic base plates 7, 7. The inner wall 2*a* of the case member 2 is formed as a cylindrical face concentric with the central axis of the dielectric resonator. In FIG. 17, an adjusting screw 8 for frequency tuning use is made of meta or dielectric. As shown, the adjusting screw 8 is engaged into a tapped hole provided in the corner portion of the case member 2. The tip 8*a* thereof is projected into the case by the rotation of the adjusting screw 8, so that the frequency tuning is effected by the amount it projects into the case.

Figure 22:
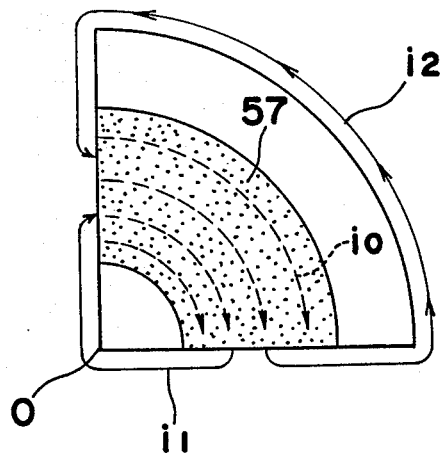
FIG. 22 is a chart showing currents flowing in the dielectric resonator and the conductor.

The paths followed by the current is shown in FIG. 22 in the dielectric resonator 57 shown in FIG. 17. An electromagnetic field distribution, with the central axis 0 of the hollow center of the dielectric resonator as its central axis, is caused within the dielectric body of the dielectric resonator 57. A displacement current i0 flows in the direction shown with broken line in the drawings. An actual current $i_1$ flows into and between the splicing portions defined between the silver electrodes 7*a*, 7*b* on the surface of the ceramic base plate 7 and the split faces 57*a*, 57*b* of the dielectric. An actual current $i_2$ flows to the inner wall 2*a* of the case member 2. As shown in FIG. 22, as the distribution of the displacement current within the dielectric becomes farther from the central axis 0, the currents flowing to the conductor are divided between $i_1$ and $i_2$, so that the currents are not concentrated on the central axis and its vicinity, thus reducing the Joule loss as a whole.

The equation is as follows.

$$Q' = (\pi\mu_0\omega/4R_s)\cdot\langle r\rangle \quad (1)$$

$$1/Q_0 = (1/Q_{0o}) + (1/Q') \quad (2)$$

$$\langle r\rangle = \int rH^2drdz / \int H^2drdz \quad (3)$$

$$RS\ (\text{skin resistance}) = \sqrt{\omega\mu/2\Sigma} \quad (4)$$

wherein $1/Q'$ is the Joule loss in the conductor, $Q_0$ is the unloaded Q, and $Q_{0o}$ is the unloaded Q in the original cylindrical dielectric resonator which is not divided into quarters.

Figure 23:
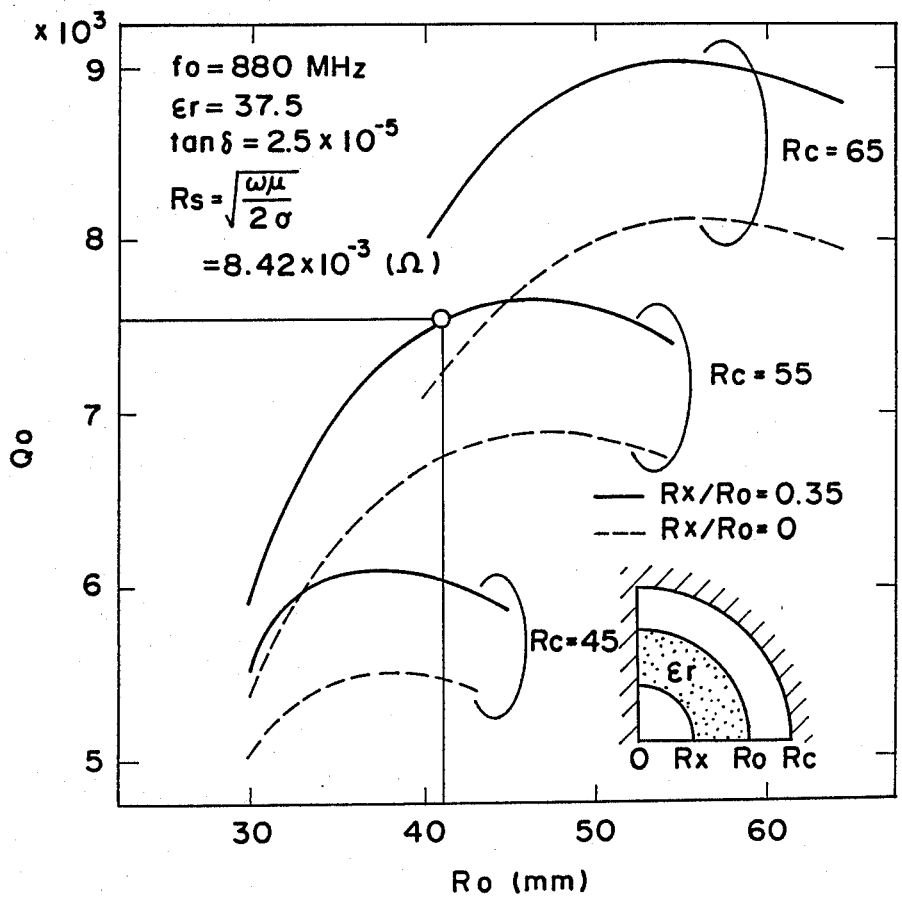
FIG. 23 is a chart showing the respective sizes of the dielectric resonator and the case, and the characteristics of the unloaded Q.

An average $\langle r\rangle$ of the expanse of the magnetic field may be calculated by a finite element method (a so-called F.E.M.) in accordance with the definition of the equation (3), with FIG. 23 showing the variation of the $Q_0$ in each size of the dielectric resonator and the case. As clear from FIG. 23, a dielectric resonator whose dielectric near the central axis is removed may be used to increase the $Q_0$. For example, when the inside diameter Rc of the case is 55 mm, the outside radius Ro of the dielectric resonator is 41 mm, and the inside radius Rx of the dielectric resonator is 0.35 of the outside radius, the $Q_0$ becomes 7500 in theoretical value, with 7100 as an actual value.

The dielectric resonator 57 or the like is heated through dielectric loss or peripheral conductor Joule loss. This heat is radiated externally from the case members 1 and 2, by way of the ceramic base plate 7 and the metallic plate 6. Also, as the dielectric resonator 57 or the like is secured by means of the ceramic base plate 7, which is bonded on the case member, the mechanical distortion caused by the difference in thermal expansion between the case member made of metallic material and the dielectric resonator made of ceramic material may be absorbed, so that the excitation of the complete $TE_{01\delta}$ mode may be maintained without the peeling off of the splicing portion defined between the silver electrode of the ceramic base plate surface and the dielectric resonator.

Figure 18:
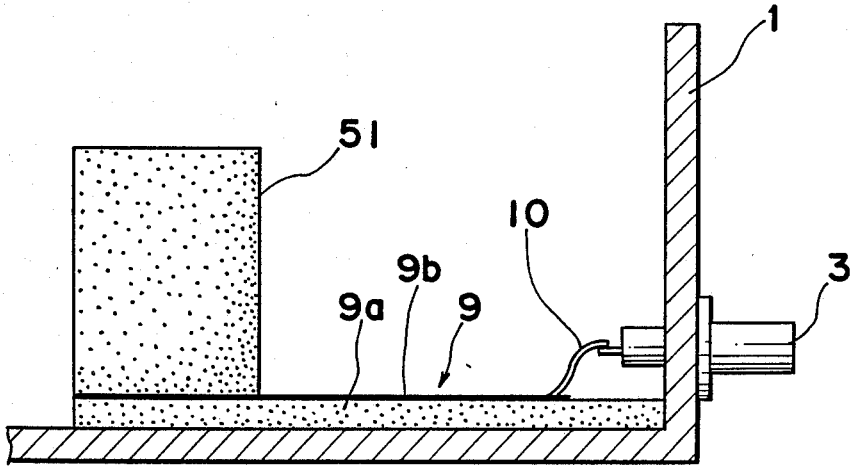
FIG. 18 is a partial longitudinal sectional view of the apparatus shown in FIG. 17.
Figure 19:
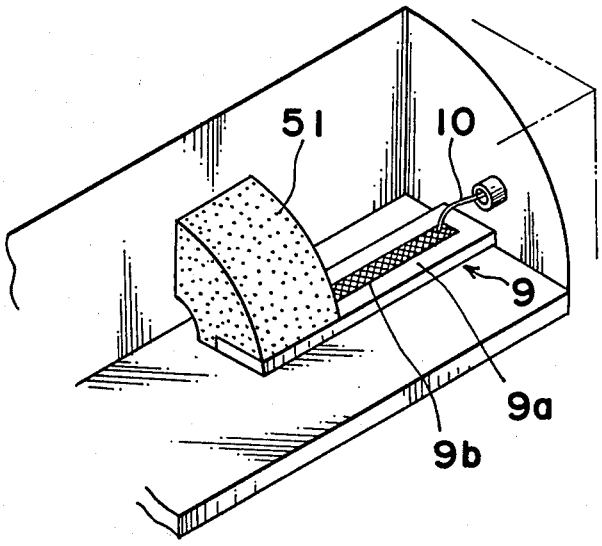
FIG. 19 is a perspective view of a portion shown in FIG. 18.

FIG. 18 shows a longitudinal section taken in the direction perpendicular to the side face of the case member with the connector 3 mounted thereon in FIG. 16. In FIG. 18, reference character 51 is a first stage dielectric resonator, reference character 9*a* is a base plate of a strip line 9, reference character 10 is a lead wire for connecting the connector 3 for input use. FIG. 19 is a perspective view showing this portion. The strip line 9 is made of a strip line base plate 9*a* and a strip conductor 9*b*, with the lead wire 10 being connected between the central conductor of the input connector 3 and the strip conductor 9*b*. The silver electrode which is formed on the bottom portion of the first stage dielectric resonator 51 is connected in direct contact with the strip conductor 9*b*. In this manner, the connection is electrically made between the dielectric resonator and the input connector. A similar circuit is constructed on the side of the output. Needless to say, the external coupling construction may be replaced by conventionally known constructions, for example, other various constructions such as a coupling construction using a loop.

Figures 20, 21:
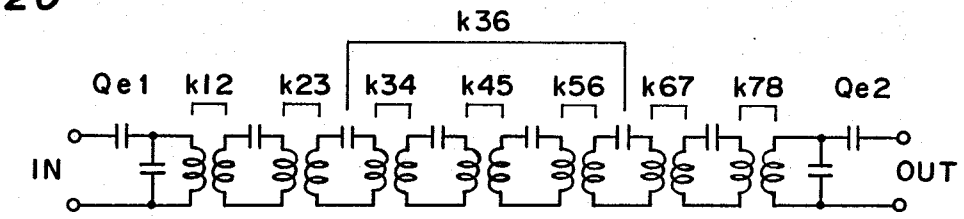
FIG. 20 is an equivalent circuit of the band-pass filter.
FIG. 21 is a chart showing the materials of the resonator and ceramic base plate constructing the apparatus, and the characteristics thereof.

The band-pass filter using the eight stages of dielectric resonator is composed in this manner. FIG. 20 shows its equivalent circuit. In FIG. 20, reference character Qe1 is a coupling portion between the connector 3 and the first stage of dielectric resonator 51, and reference character Qe2 is a coupling portion between the eight stage of dielectric resonator 58 and the connector 4. Also, reference characters K12, K23, K34, K45, K56, K67, K78 respectively show the coupling portions among the dielectric resonators having the stage number shown by the two-unit figures. In addition, reference character K36 shows the coupling portion between the third stage dielectric resonator 53, through the existence of the coupling loop L shown in FIG. 16, and the sixth stage dielectric resonator 56.

The concrete examples of the above-shown band-pass filter construction materials and sizes, and the characteristic thereof under operating conditions, are as follows.

Figures 24, 25:
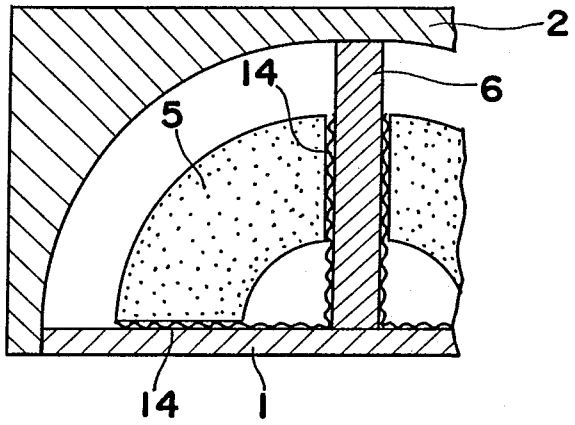
FIG. 24 is a chart showing characteristics of a concrete band-pass filter employing the apparatus of FIG. 16.
FIG. 25 is a longitudinal, sectional view showing a construction of securing the dielectric resonator in accordance with another embodiment.

FIG. 21 shows the materials of respective resonators and of the ceramic base plates for retaining these resonators. FIG. 24 shows the specifications of the band-pass filter constructed under such conditions as described hereinabove. In this manner, the band-pass filter, whose insertion loss is low and attenuation amount is large, may be constructed.

In the above-described embodiment, a ceramic base plate with the silver electrode being constructed on the surface is used when the dielectric resonator is secured in contact against the inner wall or the like of the case. However, as the current is not concentrated on the local portion of the splicing face defined between the dielectric resonator and the electric wall in this invention, it is also possible to roughly fix the resonators to some extent by elastic members made of metallic materials as shown in, for example, FIG. 25. In FIG. 25, a metallic plate or a metallic net 14 which is formed in wave-shape is secured by partial soldering or synthetic resin systems bonding agent such as epoxide or the like.

Figure 26:
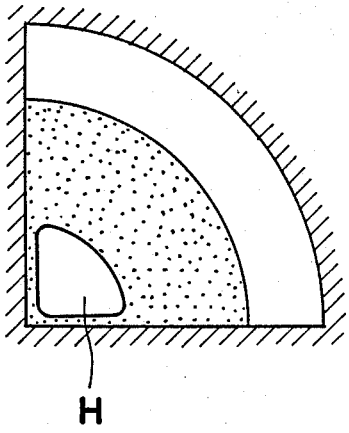
FIG. 26(A), and FIG. 26(B) are sectional views each showing the construction of the dielectric resonator according to further embodiments of the invention.
Figure 26:
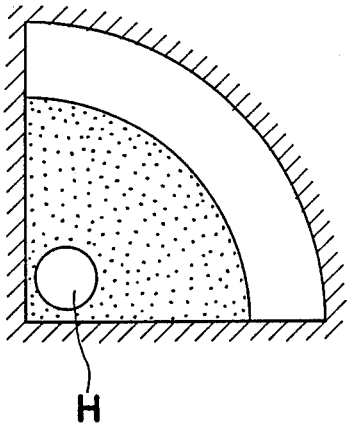

Also, in the above-described embodiment, a dielectric resonator in the form of a quarter of a hollow cylinder is used. But as shown, for example, in FIG. 26(A), and FIG. (B), it is also possible to use a quarter-cylindrical dielectric resonator formed with a through hole H therein near the central axis of the electromagnetic field distribution, whereby the dielectric material is partially removed, may be used. Likewise, the concentration of the current near the central axis may be moderated to disperse the current distribution. The through holes are provided at the corner of the resonators adjacent to the central axis with cross-sectional shapes of either a circle, as shown in FIG. 26(B), or a rounded triangle similar to the cross-section of the resonator, as shown in FIG. 26(A).

According to the second embodiment, the entire dielectric resonator apparatus may be made smaller in size by the use of a smaller dielectric resonator and case, and the current is not concentrated in the local portion of the dielectric resonator which is caused by the Joule loss increase.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A dielectric resonator apparatus, comprising a case member, at least two dielectric resonators accommodated within the case member, an input means for inputting electromagnetic wave energy into the case member, and an output means for outputting electromagnetic wave energy from the case member to the outside, each of the resonators having a flattened shape including a pair of outer planes each forming an electric wall and having first ends at which said outer planes are crossed at a given angle with each other, along a line which coincides with a central axis of the electromagnetic field distribution in the operating mode of the resonator, and another surface extending between second ends of said outer planes, and all of the resonators being arranged along an axis common to the central axis of each of the resonators so that they couple inductively with each other in the axial direction of the resonators.

2. A dielectric resonator apparatus as defined in claim 1, wherein each of the resonators has a shape of a hollow segment of a cylinder defined by a first arcuate surface of large radius, a second arcuate surface of small radius within the first arcuate surface of large radius, said first and second arcuate surfaces having a common axis, a pair of rectangular outer planes each forming an electric wall and including said common axis, and a pair of top and bottom planes each being perpendicular to said rectangular outer planes and having the shape of a cross-section of a volume between said arcuate surfaces, and wherein the pair of outer planes cross at a given angle with each other.

3. A dielectric resonator apparatus as defined in claim 1, wherein the given angle between said outer planes is a right angle.

4. A dielectric resonator apparatus as defined in claim 1, wherein the case member is made of metal, and further comprising base plate means fixed on the case member and attached to the outer planes of the resonators through conductive material, whereby said outer planes are conductively connected to the case member, the base plate being made of material having substantially the same coefficient of linear expansion as that of the resonators.

5. A dielectric resonator apparatus as defined in claim 4, wherein said base plate means comprises a plurality of base plates each corresponding respectively to one of said resonators.

6. A dielectric resonator apparatus as defined in claim 4, wherein said base plate means comprises one base plate corresponding to a plurality of said resonators.

7. A dielectric resonator apparatus as defined in claim 1, wherein both the resonators and the base plate means are made of ceramic material.

8. A dielectric resonator apparatus as defined in claim 1, wherein one of the outer planes of the resonator has a step-like cut-out space having therein conductive material connected to an external connection means for capacitively coupling the resonator with an external circuit.

9. A dielectric resonator apparatus as defined in claim 1, wherein the external connection means includes a strip line including a strip conductor inserted into the cut-out space of the resonator and connected with the conductive material provided on the outer planes of the resonator, and an earth conductor of the strip line being connected with the case member.

10. A dielectric resonator apparatus as defined in claim 1, wherein a shielding plate is provided within the case member for being interposed between a pair of resonators on both surface planes thereof, and provided with a magnetic field coupling means to transmit electromagnetic dominant wave energy therethrough between the resonators on both sides of the shielding plate, and the pair of resonators are arranged at positions at which the vectors of second harmonic waves of the resonators are crossed with each other as an integral value so as to prevent the transmission of the second harmonic waves.

11. A dielectric resonator apparatus as defined in claim 10, wherein the magnetic field coupling means is an opening provided in the shielding plate.

12. A dielectric resonator apparatus as defined in claim 1, wherein a shielding plate is provided within the case member for being interposed between a pair of resonators on both surface planes thereof, and provided with means for coupling the pair of resonators through the shielding plate so as to generate an attenuation pole therebetween.

13. A dielectric resonator apparatus as defined in claim 12, wherein said coupling means comprises an opening in the shielding plate to couple the pair of resonators.

14. A dielectric resonator apparatus as defined in claim 13, wherein said coupling means comprises a loop member communicating through the shielding plate to couple the pair of resonators.

15. A dielectric resonator apparatus as defined in claim 1, wherein at least one of the input means and output means is of a magnetic coupling type.

16. A dielectric resonator apparatus as defined in claim 15, wherein said at least one of the input means and output means includes a loop member of which one end is connected to ground.

17. A dielectric resonator apparatus as defined in claim 15, wherein said at least one of the input means and output means includes a rod member of which one end is insulated from ground.

18. A dielectric resonator apparatus as defined in claim 1, wherein the case member is made of metal and said resonators are mounted thereon by a resilient conductive member.

19. A dielectric resonator apparatus as defined in claim 1, wherein said resonators have the shape of a solid quarter-cylinder.

20. A dielectric resonator having a shape of a hollow segment of a cylinder defined by a first arcuate surface of large radius, a second arcuate surface of small radius within the first arcuate surface of large radius, said first and second surfaces having a common axis, a pair of rectangular outer planes each forming an electric wall and including said common axis, and a pair of top and bottom planes each being perpendicular to said rectangular outer planes and having the shape of a cross-section of a volume between said arcuate surfaces and wherein the pair of outer planes are crossed at a given angle with each other along said common axis, which coincides with a central axis of the electromagnetic field distribution in the operating mode of the resonator.

21. A dielectric resonator as defined in claim 20, wherein the given angle between the outer planes is a right angle.

22. A dielectric resonator as defined in claim 20, further comprising a case member made of metal, and base plate means fixed on the case member and attached to the outer planes of the resonator through conductive material, whereby said outer planes are conductively connected to the case member, the base plate being made of material having substantially the same coefficient of linear expansion as that of the resonator.

23. A dielectric resonator as defined in claim 22 wherein both the resonator and the base plate means are made of ceramic material.

24. A dielectric resonator as defined in claim 22, wherein one of the outer planes of the resonator has a step-like cut-out space having therein conductive material connected to an external connection means for capacitively coupling the resonator with an external circuit.

25. A dielectric resonator as defined in claim 24, wherein the external connection means includes a strip line including a strip conductor inserted into the cut-out space of the resonator and connected with the conductive material provided on the outer planes of the resonator, and an earth conductor of the strip line being connected with the case member.

26. A dielectric resonator as defined in claim 20, wherein the case member is made of metal and said resonator is mounted thereon by a resilient conductive member.

27. A dielectric resonator having the shape of a segment of a cylinder defined by an arcuate surface and a pair of rectangular outer planes at a given angle to each other, said pair of rectangular outer planes forming electric walls and being crossed with each other along a central axis of said arcuate surface, and by a pair of top and bottom planes each having the shape of a cross-section of the volume defined by said arcuate surface and said outer planes, said resonator being provided with a through hole disposed adjacent to and along the central axis.

28. A dielectric resonator as defined in claim 27, wherein the hole is formed with a round cross-section.

29. A dielectric resonator as defined in claim 27, wherein the given angle between the outer planes is a right angle.

30. A dielectric resonator as defined in claim 27, wherein the hole is formed with a cross-section of a shape similar to the cross-section of the resonator.

* * * * *